US005560400A

United States Patent [19]

Meyns et al.

[11] Patent Number: 5,560,400

[45] Date of Patent: Oct. 1, 1996

[54] REMOVING WASTE SELVAGE FROM WOVEN FABRIC

[75] Inventors: Ignace Meyns, Reninge; Patrick Glorie; Serge Vanrobaeys, both of Ieper, all of Belgium

[73] Assignee: Picanol n.v., Belgium

[21] Appl. No.: 431,748

[22] Filed: May 1, 1995

[30] Foreign Application Priority Data

May 4, 1994 [BE] Belgium ..... 09400457

[51] Int. Cl.[6] ..... D03D 47/40; D03D 49/70

[52] U.S. Cl. ..... 139/304; 139/302; 226/183

[58] Field of Search ..... 139/304, 302, 139/303, 291 C; 226/183

[56] References Cited

U.S. PATENT DOCUMENTS

| | | | |
|---|---|---|---|
| 3,461,920 | 8/1969 | Sakamoto | 139/302 |
| 3,760,609 | 9/1973 | Poocza et al. | 139/304 |
| 4,100,945 | 7/1978 | Resch et al. . | |
| 4,453,572 | 6/1984 | Key | 139/302 |
| 4,513,791 | 4/1985 | Dillon . | |
| 4,616,680 | 10/1986 | Lai | 139/304 |
| 4,691,743 | 9/1987 | Venot | 139/304 |

FOREIGN PATENT DOCUMENTS

| | | | |
|---|---|---|---|
| 895325 | 1/1945 | France | 226/183 R |
| 514704 | 10/1971 | Switzerland . | |

*Primary Examiner*—Andy Falik
*Attorney, Agent, or Firm*—Bacon & Thomas

[57] ABSTRACT

A method and apparatus for removing waste selvages (11) formed when weaving fabric on a loom includes a pair of selvage removal rollers (19, 23) fitted with friction coverings and driven against one another to form a gripping nip for engaging and drawing the waste selvage away from the woven fabric, whereby the waste selvage is first fed to the peripheral surface of the first one of the pair of removal rollers (19) over a wrapping angle larger than 150° and preferably larger than 180°, before reaching the clamping nip between the rollers (19,23). Alternate embodiments of the invention are described.

15 Claims, 6 Drawing Sheets

18
13
11
14
35
α
23
37
21
24
22
28
20
26
25
27
F3
33
19
16
17
15
17

REMOVING WASTE SELVAGE FROM WOVEN FABRIC

BACKGROUND OF THE INVENTION

1. Field of the Invention

This invention concerns a method and apparatus for removing waste selvage formed when weaving on an automatic loom, the removal being implemented by two removing rollers in contact with each other so as to provide a clamping or gripping nip zone between them for drawing a waste selvage away from the woven fabric, with at least one of the removing rollers being directly driven.

2. Discussion of Prior Art

It is known (i..e, U.S. Pat. No. 3,461,920) to bind selvage weft ends into waste warps and thereafter sever the selvage so as to form a main selvage that remains with the fabric and a waste selvage that includes the waste warps and waste wefts. This waste selvage is removed using a removal device and is conveyed to a collecting means, for instance a flanged winding spool or a receptacle. In the prior art device, the removal device comprises two removal rollers defining a gripping nip between them for receiving the waste selvage that is fed to the nip in a tangential manner. One of the removal rollers includes longitudinal flutes at its surface and is fitted with a drive powered by the loom breast beam. This removal roller cooperates with a second removal roller fitted with a resilient covering. The waste selvage is forced into the longitudinal flutes to achieve thereby a sort of mechanically positive locking between the waste selvage and the flutes. Such removal devices, wherein the removal force is generated exclusively at the gripping nip between the removal rollers, has a disadvantage in that the waste selvage may tear or lose tension, in particular when said waste selvage is irregular, i.e., non-uniform. As a result, the auxiliary warps no longer form an open shed in an orderly manner, resulting in an improper insertion of the wefts until it is necessary to shut down the loom to remedy the defect.

Such prior art devices furthermore also have the disadvantage that waste selvage often wraps around one of the removal rollers and results in damage to the removal device. To avoid such a problem, it is known from German O.S. 26 20 894 to make the removal rollers hollow and to perforate them for enabling expelling of compressed air through the perforations.

It is furthermore known from U.S. Pat. No. 4,616,680 to fit removal rollers with a smooth surface forming a clamping or gripping zone between them for engaging the waste selvage. In such design, the waste selvage is fed to the surface of one of the removal rollers before it reaches the gripping nip, but this roller is not driven directly. Because an idler roller in the system together with the driven roller defines the gripping nip, the first roller is frictionally driven by the waste selvage. Thereupon, the waste selvage runs over the driven roller over a wrap angle of approximately 90° towards a collection device. In such design, the removal force is introduced into the waste selvage substantially only at the gripping nip between the removal rollers.

BRIEF SUMMARY OF THE INVENTION

The object of the present invention is to create an improved method for removing waste selvage whereby difficulties encountered in the prior art during waste selvage removal are avoided to the maximum extent.

The various problems mentioned above are solved by the present invention by feeding the waste selvage to the surface of a first one of the pair of removal rollers so that it envelops the roller over a wrap angle of at least 150° before the waste selvage reaches the gripping nip between the removal rollers.

The invention also enables higher waste selvage removal forces to be generated frictionally by enabling the forces to be introduced into the waste selvage over a significant length of the selvage through one of the removal rollers before the selvage engages a waste selvage gripping nip between the rollers. Specifically, part of the waste selvage removal force is frictionally generated in the waste selvage between the time the waste selvage engages or contacts the outer surface of a first one of the pair of removal rollers and the time it enters the gripping nip between the rollers, thereby applying the removal force to the waste selvage in a gentle manner without the danger of tearing of the waste selvage.

For implementing the invention, a pair of removal rollers for removing waste selvage are spring loaded towards each other. Thus, irregularities such as knots in the waste selvage or auxiliary warps will not substantially change the removal force because sufficient removal force will be frictionally applied between the first removal roller and the waste selvage even though the two rollers may move relative to one another against the spring force. The removal force, of course, is also generated by friction between the waste selvage and the second removal roller.

In another embodiment of the invention, the waste selvage is wrapped over the second removal roller after the gripping nip by a wrap angle of at least 150°. When the second removal roller is driven directly, the angle of wrapping may be substantially reduced.

In still another embodiment of the invention, the waste selvage is diverted from the second removal roller at a distance from the first removal roller in the removal direction. This further reduces the danger of selvage winding around a roller.

The invention includes removal apparatus using directly driven removal rollers and guide means provided to feed a waste selvage to the peripheral surface of one of the removal rollers, with the second removal roller being mounted in a manner such that the gripping nip between the first and second rollers is located at a circumferential angle of at least 150° from the location on the periphery of the first roller where the waste selvage engages the peripheral surface of the first roller.

Further advantages and features of the invention will be evident from the following description of preferred embodiments of the invention with reference to the appended drawings.

DETAILED DESCRIPTION OF THE PREFERRED EMBODIMENTS

Figure 1:
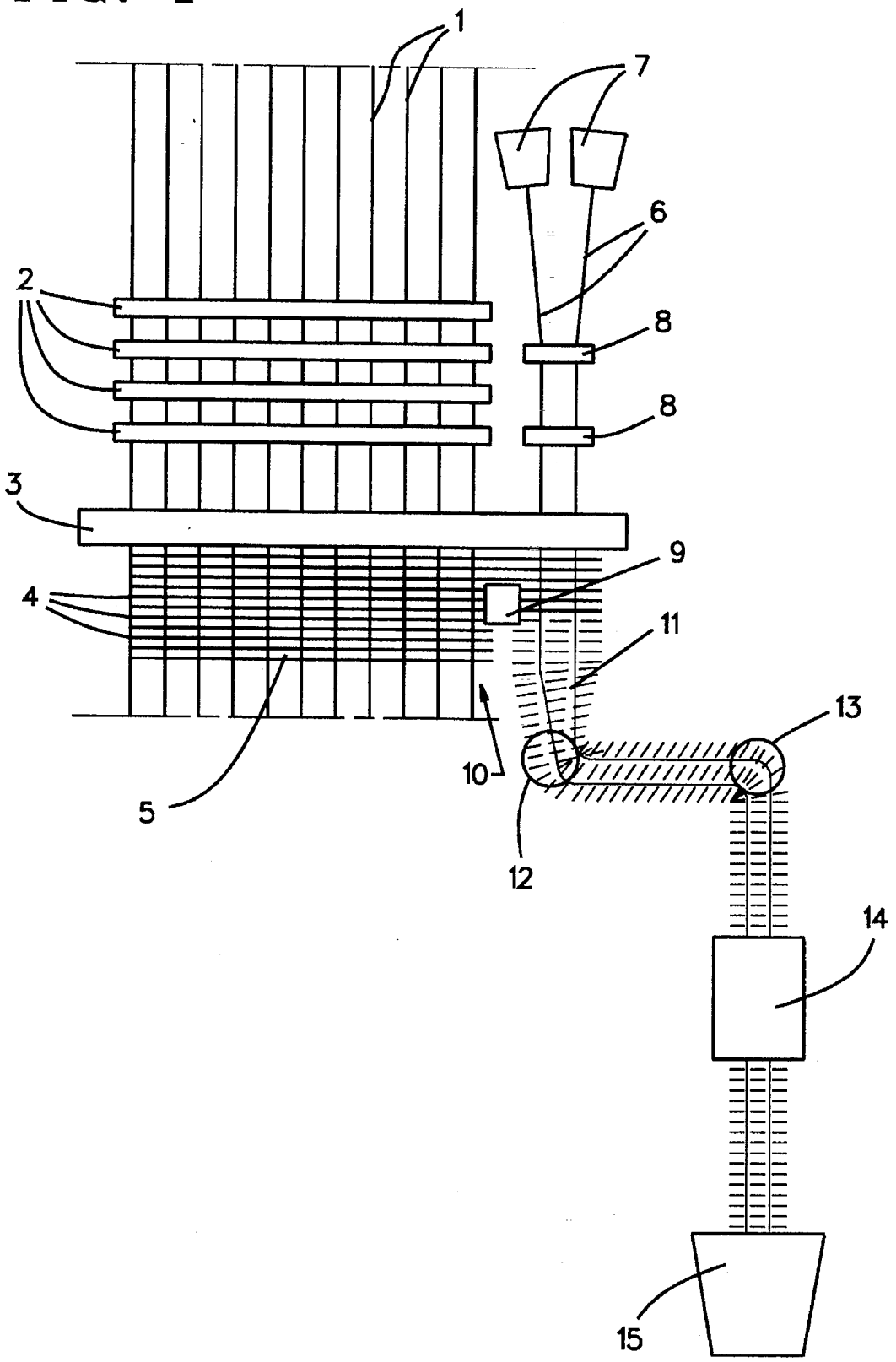
FIG. 1 is a schematic view of a loom fitted with a removal apparatus for waste selvage.

FIG. 1 shows a set of warp threads 1 coming from a warp beam (not shown) and which have been guided through a shed-former 2 and a reed 3. The shed former 2 contains, for instance, harnesses that are moved up and down in a specific pattern in order to form sheds though which the weft threads 4 are inserted through the warps 1. Using the reed 3, the wefts 4 are beaten sequentially against the beat-up edge of the fabric 5. The fabric is then guided over a breast beam (not shown) and through a removal apparatus to a cloth beam. The loose ends of wefts are also inserted into waste warps 6 drawn off their own bobbins 7 and bound. The waste warps 6 are moved up and down by their own shed former 8 in a given pattern in order to bind particular wefts 4.

In another embodiment of the invention, the waste warps 6 also are drawn off the warp beam of the loom and displaced up and down through the primary shed former 2 to make sheds in the waste warps.

A severing means 9 is provided near the fabric edge to cut the ends of wefts 4 between the retained selvage 10 and waste warps 6, whereby a so-called waste selvage 11 is formed. This waste selvage 11 consists of waste warps and the ends of the wefts 4 that are bound or woven into the waste warps 6. The waste selvage 11 is guided through guides 12 and 13 to removal apparatus 14 indicated schematically in FIG. 1 and then is drawn off this apparatus and moved into a collecting device 15, for instance a receptacle. The removal apparatus 14 draws off the waste selvage 11 at a specified speed in such a way that the waste selvage 11 and the still uncut warps 6 remain tensioned. This draw-off speed is selected in such a manner so as to approximately match the speed of the fabric 5 or somewhat higher than such speed.

Figure 2:
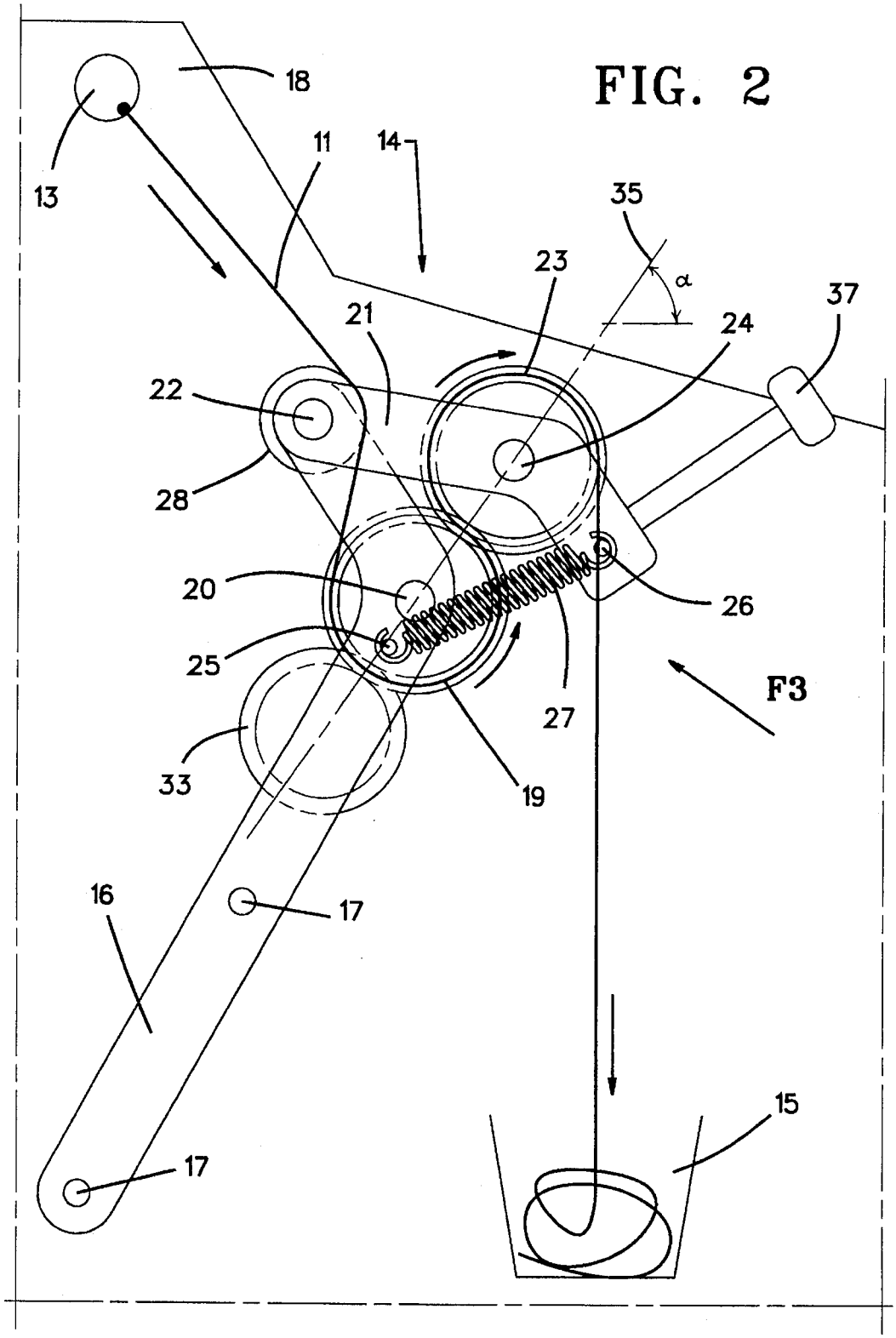
FIG. 2 is a side elevation view of the waste selvage removal apparatus of the invention illustrated on a larger scale.
Figure 3:
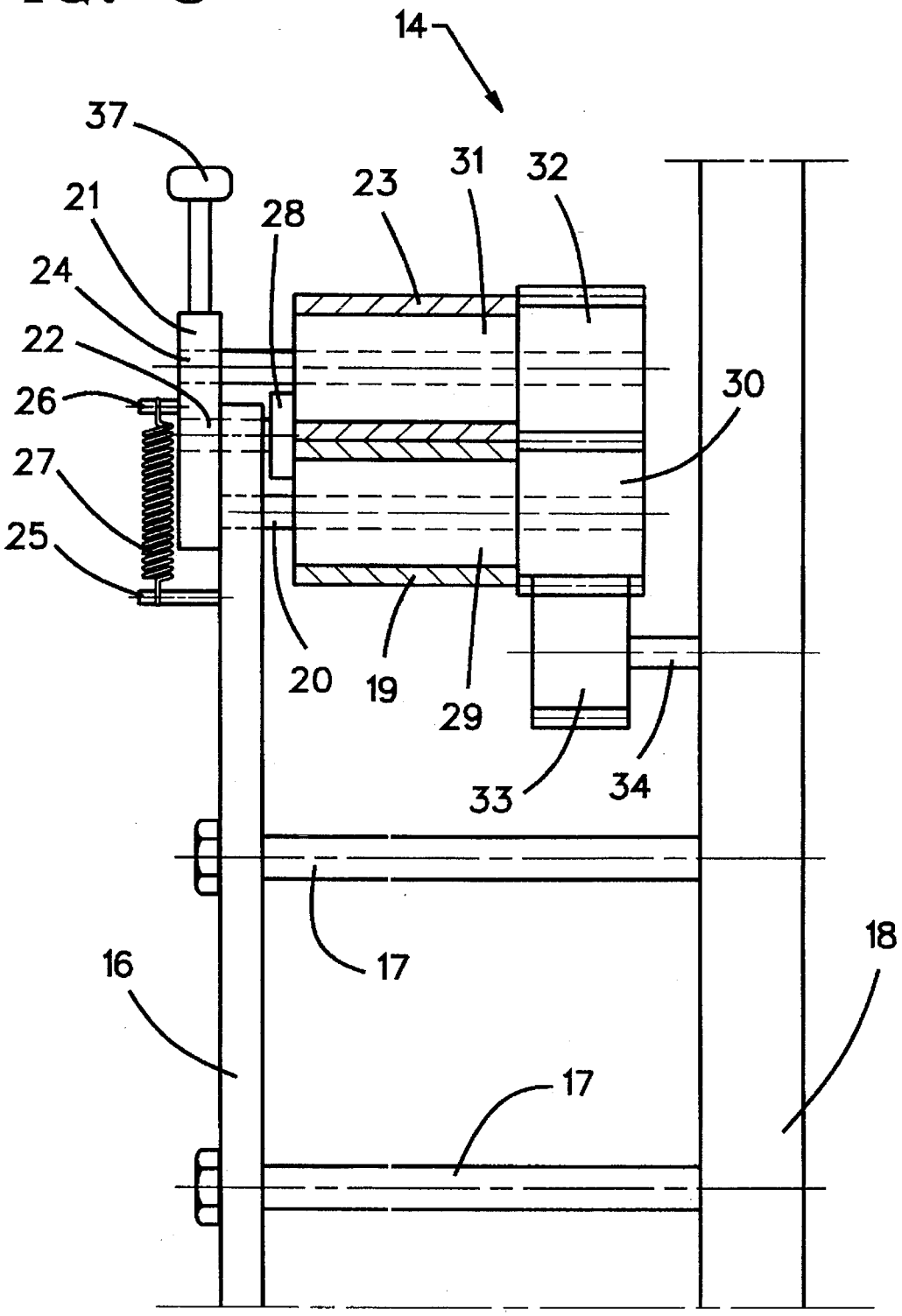
FIG. 3 is a partial section end view taken in the direction of arrow F3 of FIG. 2 (waste selvage not shown)

The removal apparatus 14 shown in FIGS. 2 and 3 includes a support 16 mounted by appropriate fasteners 17 to a machine frame 18 of the loom. The support 16 supports shaft 20 of a first removal roller 19. A lever 21 pivotally mounted for rotation about axis of shaft 22 is also mounted on support 16. This lever 21 supports the shaft 24 of a second removal roller 23. The removal rollers 19, 23 are spring-loaded against each other. For this purpose, pins 25, 26 are mounted on the support 16 and the lever 21 to engage the ends of a tension spring 27 that resiliently urges the removal rollers 19, 23 towards each other. Further, a guide roller 28 mounted on shaft 22 is provided to guide the waste selvage 11. The guide 13 is an eyelet mounted in a fixed manner on the machine frame 18. The guide 12 (FIG. 1) also may be an eyelet that may be adjustable to match the fabric width. In the embodiment shown, the collecting device 15 for the waste selvage 11 is a receptacle. However, in an alternate embodiment, the collection device may be a driven flanged bobbin (not shown) onto which the waste selvage 11 is wound under a predetermined tension.

As shown in FIG. 3, the first removal roller 19 of the pair of removal rollers comprises a roller body 29 pivotally carried on the shaft 20. A first coaxial gear 30 is affixed for instance by screws to said roller body 29. The second removal roller 23 comprises a roller body 31 pivotally carried on the shaft 24 and to which is affixed, for instance by screws, a second coaxial gear 32. The removal rollers 19, 23 are fitted with friction coverings or surfaces formed for instance of an elastomer bonded onto the roller bodies 29 and 31. The removal rollers 19, 23 are driven in mutually opposite directions at the same peripheral speed. Preferably, the gears 30, 32 are the same diameter and preferably the removal rollers 19 and 23 have the same outside diameter. The gears 30 and 32 are driven by a gear drive 33 affixed on a shaft 34 supported by the loom frame 18. The shaft 34 itself is driven by a fabric removal apparatus and/or by the loom main shaft (not shown).

The waste selvage 11 is guided in such a manner, and the removal rollers 19 and 23 are mounted in such a way, that the waste selvage 11 almost completely wraps around the periphery of the first of the pair of removal rollers 19, that is about 270°, before it arrives at the gripping nip between the first and second rollers 19, 23. Downstream of the gripping nip in the waste selvage removal direction, the waste selvage 11 loops over the second removal roller 23 over much of its periphery, that is more than 180°. The waste selvage 11 leaves the second removal roller 23 almost vertically at a location substantially away from the gripping nip between the first and second removal rollers 19 and 23, that is, at a distance corresponding to at least the radius of the second removal roller 23. As a result, the waste selvage 11 leaves the second removal roller 23 along a path substantially spaced from the first removal roller 19. The shafts 20 and 24 lie in a common plane 35 that lies approximately at an angle $\alpha$ of 45° to the horizontal (and likewise the vertical).

Because the waste selvage 11 runs while tensioned over almost the complete periphery of the first removal roller 19 before it arrives at the gripping nip between the rollers 19, 23, the invention provides the advantage that the force with which the waste selvage 11 is tensioned and removed is distributed in the waste selvage over the periphery of the first removal roller up to the gripping nip. As a result, a comparatively large friction force can be transmitted to the waste selvage without slippage. Further contributing to the transmittable tension, the removal rollers 19, 23 preferably are driven in mutually opposite directions at equal peripheral speeds.

Since the waste selvage is guided over a large angle of wrap on the periphery of the second removal roller 23, there is little danger of the waste selvage 11 winding around the first removal roller 19. Consequently, the danger of damage from such winding is very small. Because the waste selvage 11 leaves the second removal roller 23 almost vertically at a position removed from the gripping nip, again there is little danger of the waste selvage 11 wrapping around the second removal roller 23.

It should be noted that the operation of the removal apparatus 14 of the invention is independent of the tension in the waste selvage 11 between the removal apparatus 14 and the collecting device 15.

Figure 4:
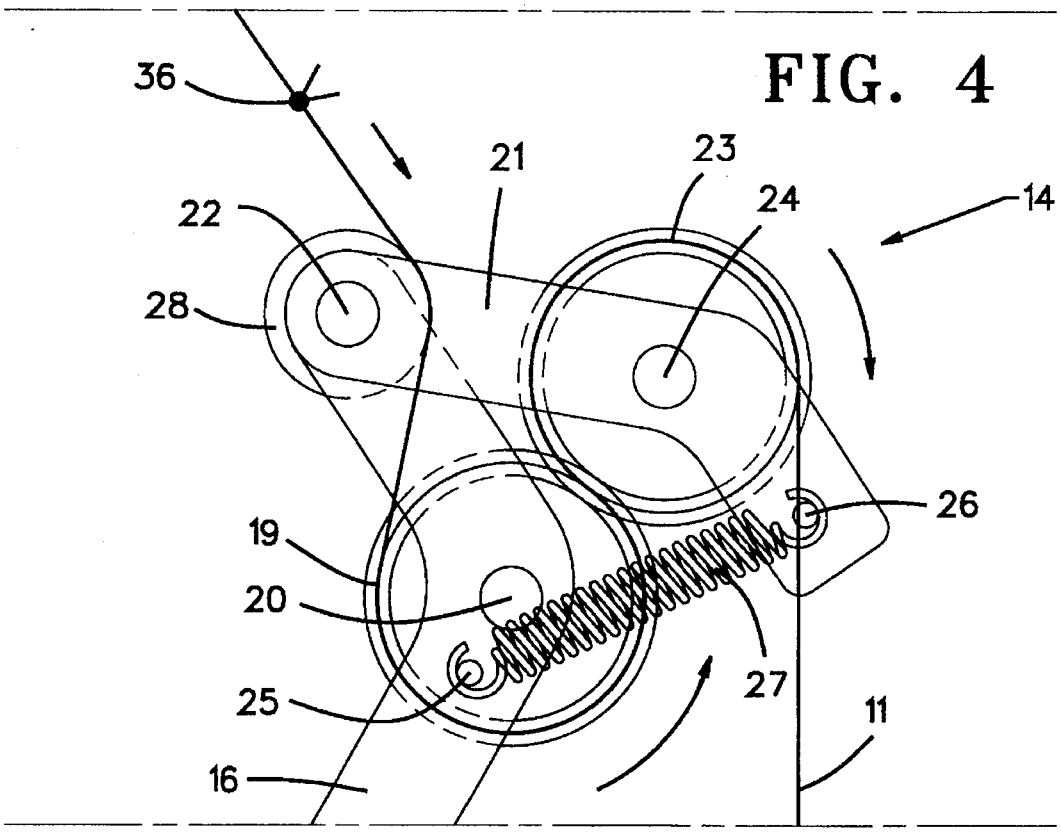
FIGS. 4 and 5 show different positions of the removal apparatus illustrated in FIG. 2, on an enlarged scale.
Figure 5:
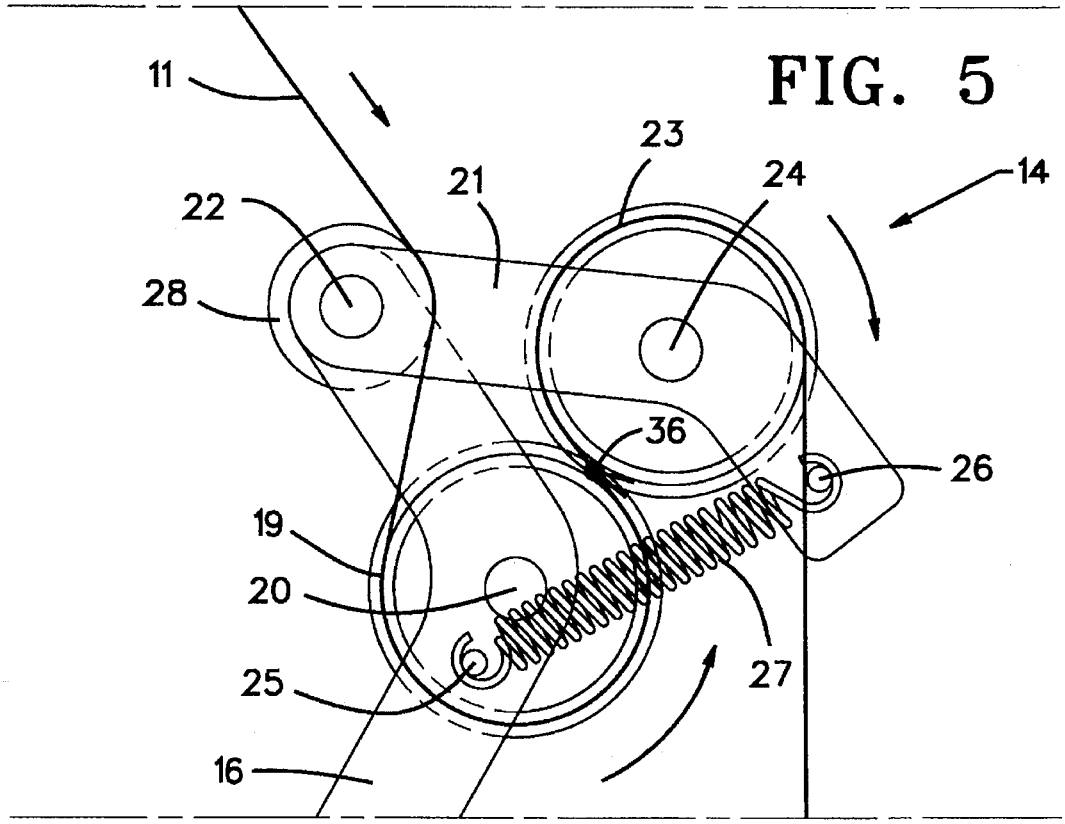

As explained in connection with FIGS. 4 and 5, irregularities 36 in the selvage 11, for instance knots in the selvage warps or an accumulation of weft ends, do not affect the appropriate operation of the removal apparatus 14. FIG. 4 shows an irregularity 36 in the waste selvage 11 moving toward the removal apparatus 14. The removal rollers 19, 23 are close to one another and the gears 30, 32 are in mesh. As the irregularity 36 enters the gripping nip between the rollers 19, 23, the rollers will move apart; however, the gears 30 and 32 will remain in mesh and continue to drive the removal rollers 19, 23. Accordingly, the irregularity 36 continues to be pulled between and through the removal rollers 19, 23 in a trouble-free manner. After the irregularity 36 has passed through, the gripping nip, the removal rollers 19, 23 as well as gears 30, 32 return into the position shown in FIG. 4.

To enable manual separation of the removal rollers 19, 23, for instance to insert a waste selvage therebetween, the invention provides a manual actuation knob 37 (FIG. 2) associated with the lever 21.

The removal apparatus 14 of the invention is applicable regardless of the width of the fabric. Only the guide 12 needs to be adjusted to accommodate various fabric widths.

Figure 6:
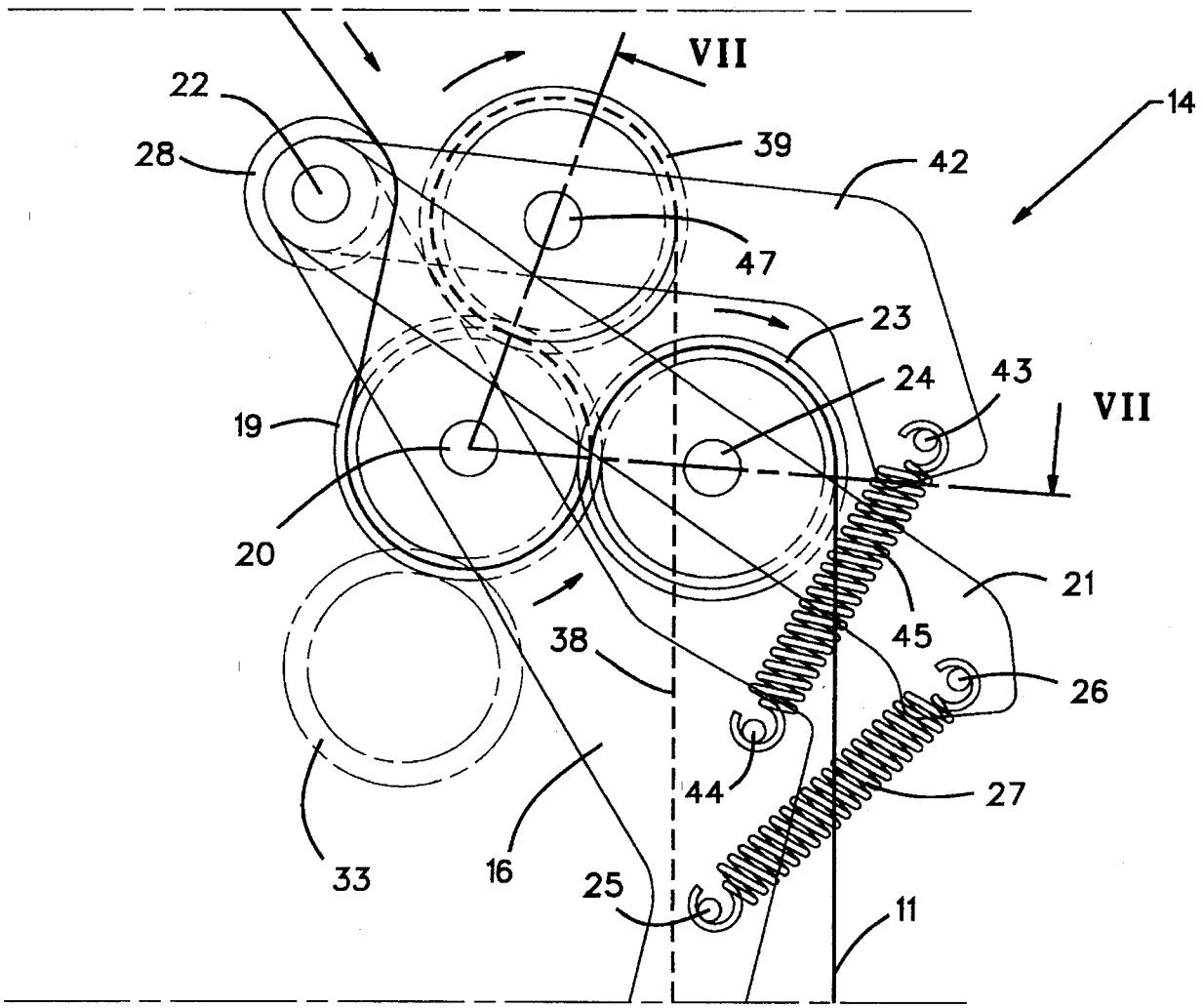
FIG. 6 is a removal apparatus similar to that illustrated in FIG. 2 for removing two waste selvages.
Figure 7:
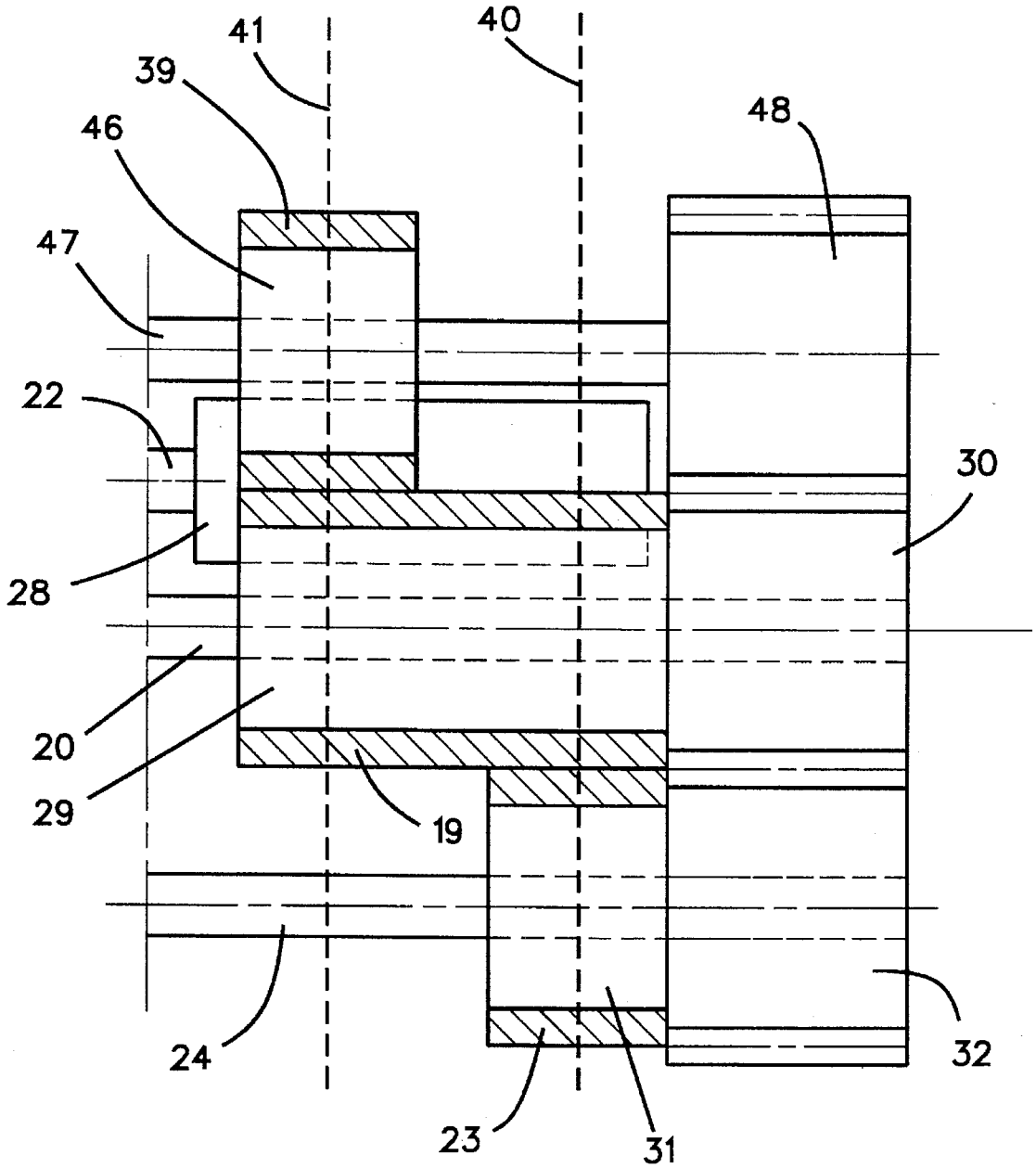
FIG. 7 is a section view along line VII—VII of FIG. 6.

As regards looms forming several waste selvages, the invention contemplates a removal apparatus 14 comprising a pair of removal rollers for each waste selvage. In the embodiment shown in FIGS. 6 and 7, a first waste selvage 11 is guided around a guide roller 28, a first removal roller 19 of a first pair of removal rollers, through the first gripping nip between the first removal roller 19 and the second removal roller 23, and around the second removal roller 23, finally leaving said second roller in a vertical direction. The removal apparatus 14 furthermore draws a second waste selvage 38 which is guided around the guide roller 28, first around the first of a second pair of removal rollers 19 and then through a gripping nip between the second pair of removal rollers 19, 39 and then around the second removal roller 39 at the second pair of rollers until it leaves the second removal roller 39 also in the vertical direction. The first waste selvage 11 moves in a plane 40, whereas the second waste selvage 38 moves in a plane 41 that is somewhat axially spaced from the plane 40. The second removal roller 23 of the first pair of rollers for drawing the first waste selvage 11 and the second removal roller 39 of the second pair of rollers for drawing the second waste selvage 38 are also mounted in axially spaced relationship from each other. Two waste selvages 11 and 38 are preferably guided by the same guide roller 28 and both pairs of removal rollers may share a common roller 19.

In accordance with another embodiment of the invention, the common first removal roller 19 is replaced by two removal rollers (not shown) that are mounted in an offset manner on the shaft 20 and which cooperate with the second removal roller 23 and the second removal roller 39.

The second removal roller 39 of the second pair of removal rollers for the second waste selvage 38 also is supported by a second pivotally mounted lever 42 attached to the support 16 so as to be pivotable about the axis of shaft 22 of guide roller 28. The first lever 21 supporting the second removal roller 23 of the first pair of rollers 19, 23 for drawing the first waste selvage 11 is pivotable about the same axis of shaft 22. The support 16 and lever 42 are provided with pins or the like 43, 44 that engage a tension spring 45 for the purpose of drawing the second removal roller 39 towards the first removal roller 19. The second removal roller 39 is supported on shaft 47 via a roller body 46 carried by lever 42.

The gear 30 of the removal roller 19 is driven by the drive gear 33 that, in turn, drives both the gear 32 of the second removal roller 23 and the gear 48 of the second removal roller 39. The gear 48 of the second removal roller 39 is mounted in a fixed manner on the shaft 47 to which the removal roller 39 also is fixedly attached.

The two removal rollers 23, 29 are displaced relative to the first removal roller 19 against a spring force independently from each other. Accordingly, and as explained above in relation to FIGS. 4 and 5, irregularities in the waste selvages 11, 38 are able to run through the removal roller pairs 19, 23 and 19, 39.

In accordance with another embodiment of the invention, the drive gear 33 is driven by its own drive motor that drives the removal rollers 19, 23, and 39 substantially at a peripheral speed corresponding to the speed of the fabric 5. In a further variation, the removal rollers 19, 23 or 19, 39 are each driven by their own, separately controlled drive motor (not shown).

The removal apparatus of the invention 14 is applicable to all types of looms forming a waste selvage. The invention is independent of the kind of weft insertion system, whether air jets, grippers, projectiles or others. Also, the invention operates independently of the mechanism for forming the warp sheds. It is to be understood that the foregoing is a description of preferred embodiments only of the invention and that it will be evident to a person of ordinary skill that the specific embodiments may be varied without departing from the scope of the invention which is intended to be defined in the claims that follow.

We claim:

1. A method for removing waste selvage formed during weaving fabric on a loom, comprising:

providing a pair of positively driven waste selvage removal rollers that define a waste selvage gripping nip between them;

feeding a waste selvage formed during weaving to the gripping nip with the waste selvage wrapped around a first one of the rollers over a wrap angle of at least 150° extending between the point of first engagement between the waste selvage with the first roller periphery and the gripping nip.

2. A waste selvage removal apparatus as claimed in claim 1, including driving the pair of removal rollers at the same peripheral speed.

3. The method as claimed in claim 1 or 2, including resiliently biasing the removal rollers against each other at the gripping nip.

4. The method as claimed in claim 1 or 2, wherein, after exiting the gripping nip, the waste selvage is wrapped over the second one of the pair of removal rollers over a wrap angle extending at least 150°.

5. The method as claimed in claim 1 or 2, including causing the waste selvage to exit the second one of the pair of removal rollers at a predetermined distance away from the first one removal roller.

6. In a weaving loom including a device for forming selvage on the edge of a fabric woven by the loom the improvement comprising:

means for separating at least a portion of the selvage from the fabric in the form of a continuous strip during weaving of the fabric;

at least a pair of waste selvage removal rollers arranged to form a gripping nip between the rollers for engaging and drawing the waste selvage strip away from said fabric;

means for feeding the waste selvage strip continuously to the gripping nip during weaving of the fabric, including a means for feeding the waste selvage strip over one of the pair of removal rollers before the selvage strip is engaged by the gripping nip, said feeding means being arranged to cause said waste selvage strip to be wrapped about said one removal roller over a wrap angle of at least 150°extending between the point of first engagement between the waste selvage strip and the periphery of said one removal roller and the gripping nip.

7. A waste selvage removal apparatus as claimed in claim 6, including means for positively driving each of the pair of removal rollers in rotation so as to draw the waste selvage in a removal direction.

8. A waste selvage removal apparatus as claimed in claim 6 or 7, including means for resiliently urging the removal rollers towards each other at the gripping nip area.

9. A waste selvage removal apparatus as claimed in claim 6 or 7 including means for mounting one of said pair of removal rollers for movement towards and away from the gripping nip.

10. A waste selvage removal apparatus as claimed in claim 6 or 7, including a guide roller for the waste selvage disposed ahead of said one of the removal rollers relative to the waste selvage removal direction.

11. A waste selvage removal apparatus as claimed in claim 6 or 7, including support shafts for said removal rollers, said shafts lying in a common imaginary plane subtending an angle of 45° to the horizontal.

12. A waste selvage removal apparatus as claimed in claim 6, including a second pair of removal rollers for removing a second waste selvage during weaving, said second pair of removal rollers being urged towards each other to form a second waste selvage gripping nip, a means for feeding a second waste selvage formed during weaving to the second gripping nip, and means for feeding the second waste selvage over the periphery of one of the second pair of removal rollers over a wrap angle of at least 150° between the point of engagement on said one of the second pair of removal rollers and the second gripping nip.

13. A waste selvage removal apparatus as claimed in claim 12, wherein said first and second pairs of removal rollers share a common roller.

14. A waste selvage removal apparatus as claimed in claim 6, wherein the wrap angle about said one removal roller is 270°.

15. A waste selvage removal apparatus as claimed in claim 6, including elastomeric friction coatings covering the periphery of the removal rollers.

* * * * *